United States Patent [19]

Wood

[11] 4,450,956

[45] May 29, 1984

[54] ARTICLE CARRIER

[75] Inventor: Prentice J. Wood, Hapeville, Ga.

[73] Assignee: The Mead Corporation, Dayton, Ohio

[21] Appl. No.: 517,738

[22] Filed: Jul. 29, 1983

Related U.S. Application Data

[63] Continuation of Ser. No. 297,092, Aug. 28, 1981, abandoned.

[51] Int. Cl.[3] ..... B65D 85/40

[52] U.S. Cl. ..... 206/188; 206/191; 206/193

[58] Field of Search ..... 206/193, 180, 181, 183, 206/184–191; 229/28 BC

[56] References Cited

U.S. PATENT DOCUMENTS

| | | | |
|---|---|---|---|
| 3,400,856 | 9/1968 | Areson | 206/188 |
| 3,568,880 | 3/1971 | Harreison | 206/188 |
| 4,144,966 | 3/1979 | Kulig | 206/188 |
| 4,253,565 | 3/1981 | Chidsey, Jr. | 206/193 |

*Primary Examiner*—Joseph Man-Fu Moy

*Attorney, Agent, or Firm*—Rodgers & Rodgers

[57] ABSTRACT

An article carrier comprising a bottom wall, a pair of side walls and end wall panels upstanding from the bottom wall, a pair of riser panels and a pair of medial panels, joined respectively to the medial edges of the end wall panels at the associated ends of the carrier and extending inwardly therefrom, handle structure joined to the riser panels and the medial panels and extending upwardly therefrom, a transverse partition panel joined to one of the medial panels and extending between the one medial panel and the associated side wall, an anchoring tab foldably joined to the transverse partition panel and being adhered to the associated side wall, and the upper portion of the transverse partition panel being bowed outwardly toward the associated end of the carrier.

10 Claims, 8 Drawing Figures

ARTICLE CARRIER

This is a continuation of application Ser. No. 297,092 filed Aug. 28, 1981, now abandoned.

TECHNICAL FIELD

This invention relates to article carriers which are economical to produce and at the same time are aesthetically pleasing in appearance.

BACKGROUND ART

Article carriers are known in which at least a portion of the anchoring means for certain of the transverse partition panels is struck in part from one or more of the carrier end wall panels. Of course this causes the carrier to be unattractive in appearance.

DISCLOSURE OF THE INVENTION

By this invention an article carrier is provided and comprises a bottom wall, spaced side walls and end wall panels, riser panels joined to the end wall panels at one end of the carrier and extending inwardly therefrom, medial panels joined to the end wall panels at the other end of the carrier and extending inwardly therefrom, handle structure joined to the riser and medial panels and upstanding therefrom, a transverse partition panel joined to one of the medial panels and extending outwardly substantially to the associated side wall and being disposed in an angular relation to the associated side wall which is slightly different from perpendicular, an anchoring tab joined to the transverse parition panel and being adhered to the associated side wall, and the upper portion of the transverse partition panel being bowed outwardly toward the associated end of the carrier.

BEST MODE FOR CARRYING OUT THE INVENTION

Figure 1:
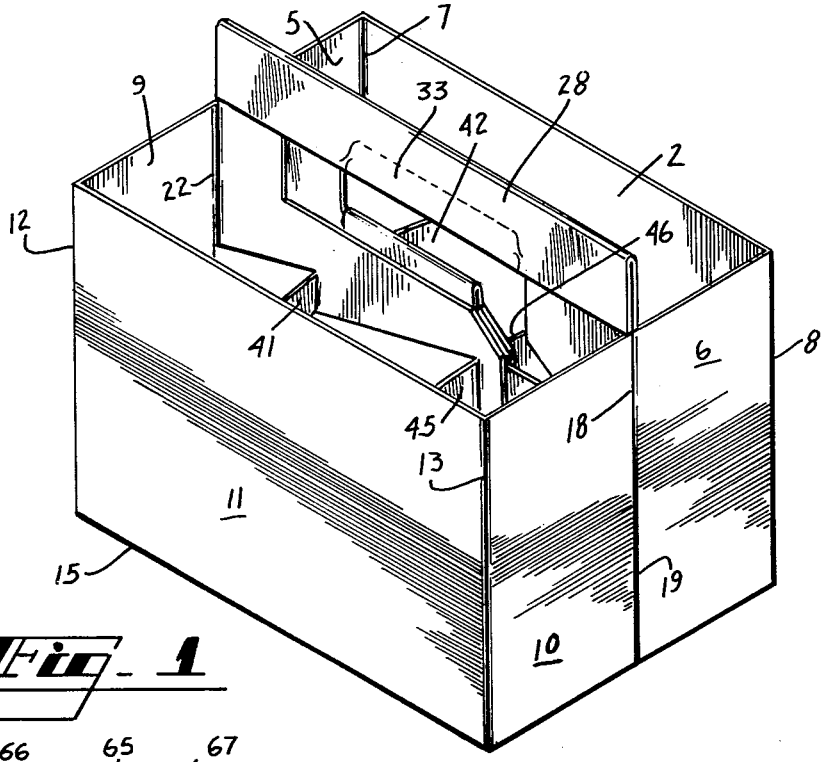
FIG. 1 is an isometric view of an article carrier constructed according to this invention.

In the drawings the numeral 1 designates the bottom wall of the carrier to a side edge of which side wall 2 is foldably joined along fold line 3. In addition, bottom wall 1 is provided with medial fold line 4.

End wall panels 5 and 6 are foldably joined to the end edges of side wall 2 respectively along fold lines 7 and 8. In like manner end wall panels 9 and 10 are foldably joined respectively to the end edges of side wall 11 along fold lines 13. Anchoring flap 14 is joined to the lower edge of side wall 11 along fold line 15. Also riser panels 16 and 17 are joined respectively to end wall panels 10 and 6 along fold lines 18 and 19.

Medial structure for the carrier is provided in a form of medial panels 20 and 21 which are foldably joined respectively to end wall panels 9 and 5 along fold lines 22 and 23. In addition, medial partition panels 24 and 25 are joined to the upper and lower edges respectively of medial panel 21 along fold lines 26 and 27.

Handle structure for the carrier is provided in the form of handle panels 28, 29, 30, and 31. Handle panels 28 and 29 are joined respectively to riser panels 16 and 17 along fold lines 18 and 19 and handle panel 30 is joined to handle panel 28 along fold line 32. Hand cushioning means is provided in the form of flaps 33 and 34 which are joined respectively to handle panels 28 and 29 along fold lines 35 and 36. Additionally, handle panel 28 is joined to handle panel 29 along fold line 37 and, in similar fashion, handle panel 30 is joined to handle panel 31 along fold line 38. Also locking tab 39 is joined to handle panel 29 along fold line 40.

Transverse partitioning structure for the carrier is provided in the form of transverse partition panels 41 and 42 which are joined respectively to medial panels 20 and 21 along fold lines 43 and 44.

Additional transverse partition structure is provided in the form of transverse partition panels 45 and 46. More specifically, transverse partition panel 45 is joined to medial panel 20 by means of fold line 47 and web panel 48. In similar fashion, transverse partition panel 46 is joined to medial panel 21 by means of fold line 49 and web panel 50.

Transverse partition panel 41 is provided with anchoring tab 51 which is joined thereto by means of fold lines 52 and 53. In like manner anchoring tab 54 is joined to transverse partition panel 42 along fold lines 55 and 56.

Figure 2:
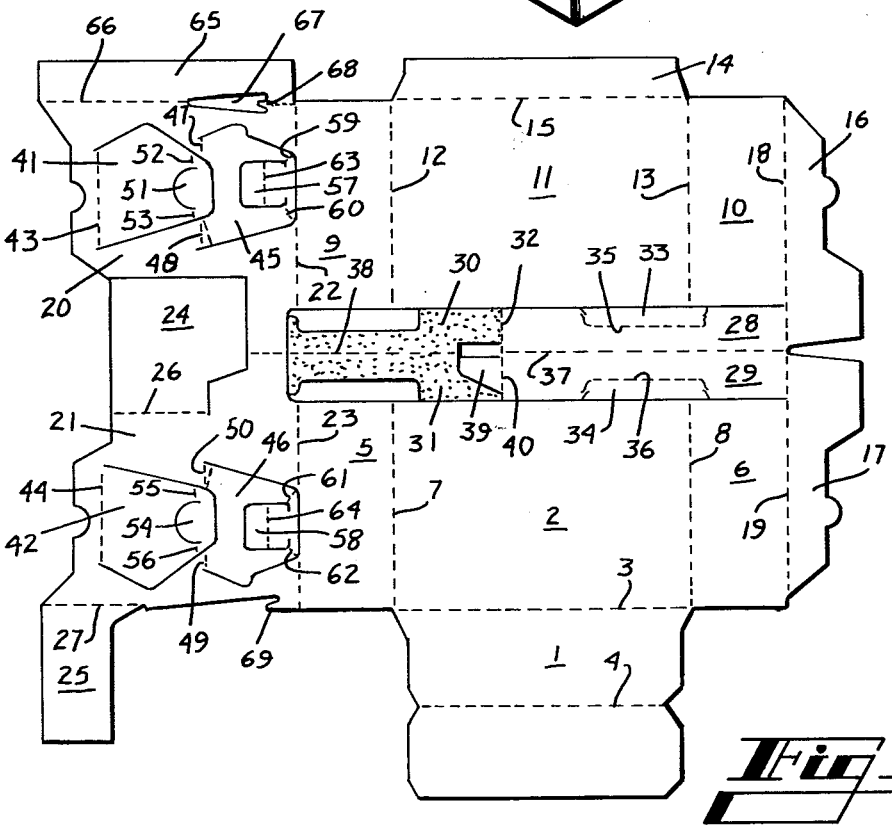
FIG. 2 is a plan view of the blank from which the carrier is formed.

As best viewed in FIG. 2, anchoring tabs 57 and 58 are struck substantially respectively from transverse partition panels 45 and 46. Further anchoring tab 57 is joined to transverse partition tab 45 along angular fold lines 59 and 60, and in like manner, anchoring tab 58 is joined to transverse partition panel 46 along angular fold lines 61 and 62. Anchoring tabs 57 and 58 are provided with bend lines 63 and 64.

According to another feature of this invention, keel panel 65 is joined to the lower edge of medial panel 20 along fold line 66 and locking aperture 67 is formed astride the fold line 66. Also locking tab 68 is formed along the periphery of locking aperture 67. To complete the locking structure, locking tab 69 is formed along the lower edge of medial panel 21.

In order to from the carrier from the blank shown in FIG. 2, initially it is necessary to apply glue to handle panels 30 and 31 as shown by stippling in FIG. 2. Then it is simply necessary to elevate and fold handle panels 30 and 31 upwardly and to the right along fold line 32 into the positions shown in FIG. 3. Then medial partition panel 24 is folded rearwardly and downwardly, as viewed in FIG. 2, along fold line 26. Also riser panels 16 and 17 are elevated and folded to the left respectively along fold lines 18 and 19. The carrier then appears as shown in FIG. 3.

Figure 3:
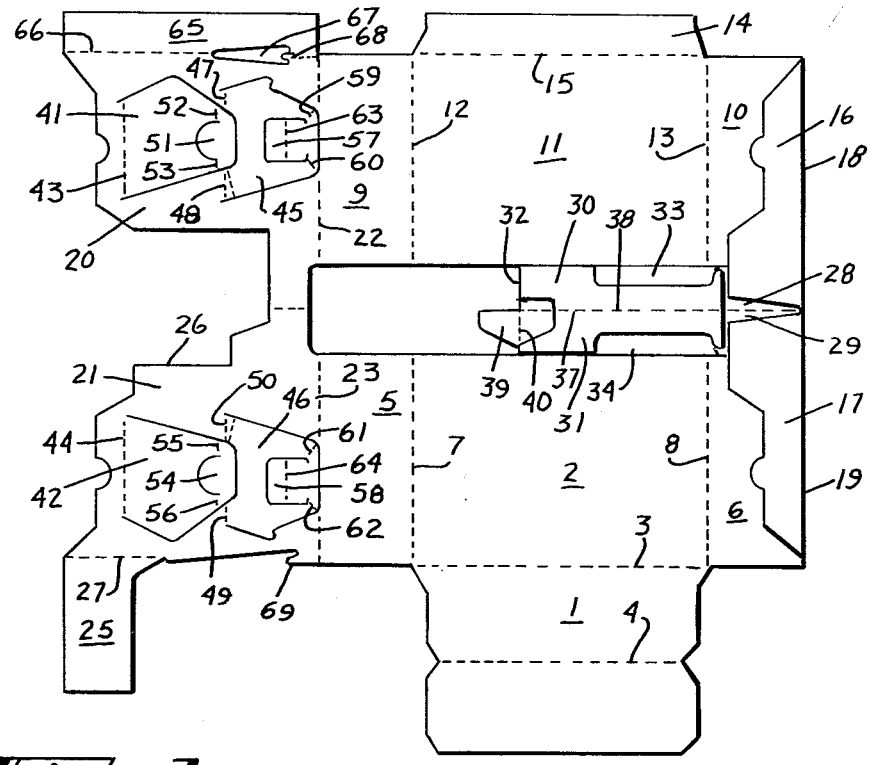
FIGS. 3, 4, 5 and 6 depict intermediate stages through which the carrier is folded and glued into a complete and collapsed carrier as shown in FIG. 7.
Figure 4:
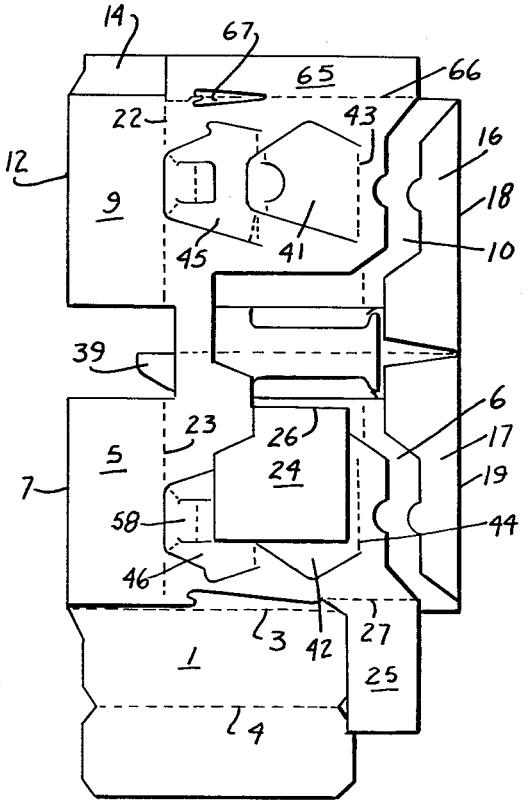

Thereafter glue is applied to anchoring tabs 51, 54, 57 and 58 as shown by stippling in FIG. 3. Following this the medial structure for the carrier is elevated and folded over along fold lines 7 and 12 into the positions shown in FIG. 4.

Figure 5:
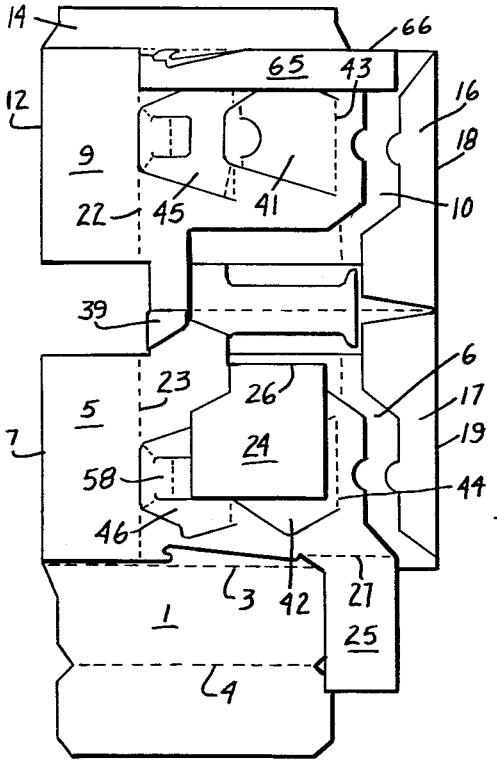
Figure 6:
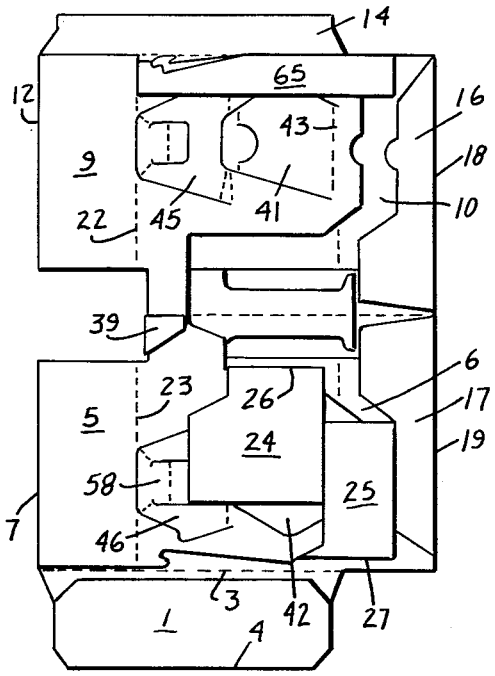

Then locking tab 39 is folded upwardly and to the right along fold line 40 into an interlocking relationship with medial panel 21 as best shown in FIGS. 5 and 6. Also keel panel 65 is folded downwardly along fold line 66. The carrier then appears as shown in FIG. 5.

Figure 7:
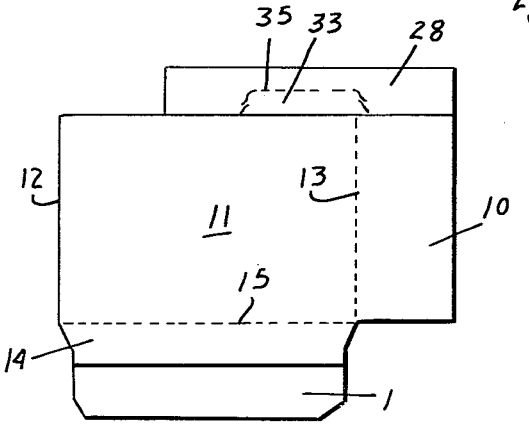
Figure 8:
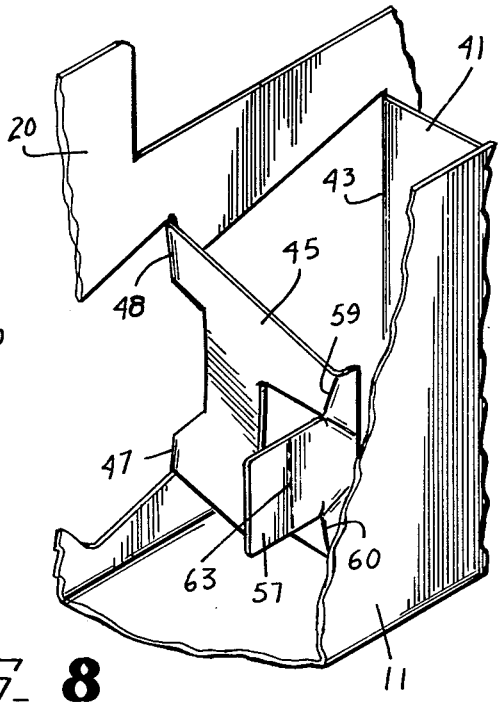
FIG. 8 is an isometric view of a portion of the transverse partition structure.

Following this operation, medial partition panel 25 is elevated and folded over along fold line 27. Also bottom wall 1 is folded along medial fold line 4 to occupy the position shown in FIG. 6. Then an application of glue is made to anchoring flap 14 as well as to medial panels 20 and 21, keel panel 65, riser panels 16 and 17, handle panels 30 and 31, and medial partition panels 24 and 25, as shown by stippling in FIG. 6. Then the portions of the carrier disposed above fold line 38 are simply elevated and folded downwardly to occupy the positions shown in FIG. 7 which represents the carrier in complete and collapsed condition.

In order to set up the carrier, it is simply necessary to expand side walls 2 and 11 into positions whereby bottom wall 1 folds into a flat plane. Then the associated end of bottom wall 1 is manipulated into locking engagement with locking tabs 68 and 69.

Since anchoring tabs 57 and 58 are struck substantially from the respective transverse partition panels 45 and 46 and not from end panels 9 and 5, when the carrier is fully assembled and glued, the structural relationships between transverse partition panels 45 and 46 and the other elements of the carrier cause these panels to assume an angular relationship with respect to the medial structure and the side walls which varies slightly from perpendicular. This causes the associated end cell to be somewhat large in size than desired.

In order to compensate for the oversized end cells, the upper portions of transverse partition panels 45 and 46 are caused to bow slightly outwardly whereby proper spacing is achieved between the transverse partition panel and the associated end wall panel. This is accomplished by means of web panels 48 and 50 which, when the carrier is set up, cause the upper portions of transverse partition panels 45 and 46 to bow or bend toward the respective end wall panels 9 and 5.

To further cause transverse partition panels 45 an 46 to bend in an outward fashion along the upper portions thereof, angular fold lines 59–62 are provided. Since fold lines 59–62 diverge outwardly with respect to the ends of transverse partition panels 45 and 46, as the carrier is set up, additional stress is introduced along the upper portions thereof thereby causing them to bow outwardly.

INDUSTRIAL APPLICABILITY

By this invention a carrier is provided which is economical to produce, aesthetically pleasing and at the same time compensates for inherent undesirable angular dispositions of certain of the transverse partition panels.

I claim:

1. An article carrier comprising a bottom wall, a pair of side walls foldably joined respectively to the side edges of said bottom wall, end wall panels foldably joined respectively to the end edges of said side walls and extending inwardly therefrom, medial panels foldably joined respectively to the medial edges of said end wall panels at one end of the carrier and extending inwardly therefrom, handle structure joined at one end to the upper portions of said medial panels and extending upwardly therefrom, a full cell width single ply transverse partition panel struck entirely from and foldably joined to one of said medial panels and being initially disposed in a coplanar relationship therewith and being adapted to move through an angle of approximately 90° during formation of the carrier to a position extending substantially outwardly to the associated side wall, a web panel foldably joining an upper part of said transverse partition panel to said one medial panel, and an anchoring tab struck entirely from said transverse partition panel and joined thereto remote from said medial panel and being adhered to said associated side wall.

2. An article carrier according to claim 1 wherein said anchoring tab is joined to said transverse partition panel by means of an angular fold line.

3. An article carrier according to claim 1 wherein said anchoring tab is joined to said transverse partition panel by means of a pair of angular fold lines.

4. An article carrier according to claim 1 wherein said transverse partition panel is disposed at an angular relation to said associated side wall which is slightly different from perpendicular.

5. An article carrier according to claim 1 wherein the upper portion of said transverse partition panel is bowed outwardly.

6. An article carrier according to claim 1 wherein said anchoring tab is joined to said transverse partition panel along a fold line which is spaced inwardly from the end of said transverse partition panel.

7. An article carrier according to claim 1 wherein a keel panel is foldably joined to the lower edge of one of said medial panels, a locking aperture is disposed astride the fold line between said keel panel and said one medial panel, and a locking tab is disposed along the periphery of said locking aperture and is arranged to cooperate with one end edge of said bottom wall to maintain the carrier in a set up condition.

8. An article carrier according to claim 7 wherein another locking tab is formed along the lower edge of the other of said medial panels and arranged to cooperate with said one end edge of said bottom wall.

9. An article carrier comprising a bottom wall, a pair of side walls foldably joined respectively to the side edges of said bottom wall, end wall panels foldably joined respectively to the end edges of said side walls and extending inwardly therefrom, medial panels foldably joined respectively to the medial edges of said end wall panels at one end of the carrier and extending inwardly therefrom, handle structure joined at one end to the upper portions of said medial panels and extending upwardly therefrom, a transverse partition panel struck entirely from and foldably joined to one of said medial panels and extending substantially outwardly to the associated side wall, an anchoring tab struck entirely from said transverse partition panel and joined thereto remote from said medial panel and being adhered to said associated side wall, and said transverse partition panel being disposed at an angular relation to said associated side wall which is slightly different from perpendicular.

10. An article carrier blank comprising a bottom wall, a first side wall joined to a side edge of said bottom wall, a pair of end wall panels joined respectively to the end edges of said first side wall, a first medial panel joined to one of said end wall panels remote from said first side wall, a second medial panel joined to said first medial panel, a pair of medial partition panels foldably joined to one of said medial panels along the upper and lower edges thereof respectively, a third end wall panel joined to said second medial panel, a second side wall joined to said third end wall panel remote from said second medial panel, a fourth end wall panel joined to said second side wall remote from said third end wall panel, a pair of transverse partition panels joined respectively to said medial panels and being struck entirely therefrom, and a pair of anchoring tabs joined respectively to said transverse partition panels and being struck entirely therefrom.

* * * * *